US005308730A

United States Patent [19]

Suzuki et al.

[11] Patent Number: 5,308,730

[45] Date of Patent: May 3, 1994

[54] LIQUID DEVELOPER FOR ELECTROSTATIC PHOTOGRAPHY

[75] Inventors: Nobuo Suzuki; Yutaka Sakasai; Seiji Horie; Eiichi Kato, all of Shizuoka, Japan

[73] Assignee: Fuji Photo Film Co., Ltd., Kanagawa, Japan

[21] Appl. No.: 966,347

[22] Filed: Oct. 26, 1992

[30] Foreign Application Priority Data

Oct. 24, 1991 [JP] Japan ..... 3-277741

[51] Int. Cl.[5] ..... G03G 9/135

[52] U.S. Cl. ..... 430/115

[58] Field of Search ..... 430/115

[56] References Cited

U.S. PATENT DOCUMENTS 4,229,513 10/1980 Merrill et al. ..... 430/115
4,547,449 10/1985 Alexandrovich et al. ..... 430/115
4,579,803 4/1986 Kato et al. ..... 430/114
5,100,751 3/1992 Kato et al. ..... 430/115 X

FOREIGN PATENT DOCUMENTS 61-162059 7/1986 Japan .

OTHER PUBLICATIONS

*Organic Chemistry,* Sixth Edition, Robert T. Morrison and Robert N. Boyd, colophon and pp. 727, 767, and 768.

*Primary Examiner*—Roland Martin
*Attorney, Agent, or Firm*—Sughrue, Mion, Zinn, Macpeak & Seas

[57] ABSTRACT

There is disclosed a liquid developer composition for electrostatic photography, which comprises, in a nonaqueous solvent having an electric resistance of $10^9$ Ω.cm or over and a dielectric constant of 3.5 or over, a toner particle, a charge-controlling agent or resin, and an acid group containing polymer soluble in said nonaqueous solvent and/or a quaternary ammonium salt.

20 Claims, No Drawings

LIQUID DEVELOPER FOR ELECTROSTATIC PHOTOGRAPHY

FIELD OF THE INVENTION

The present invention relates to a liquid developer and a charge-controlling agent to be used for developing an electrostatic latent image.

BACKGROUND OF THE INVENTION

Generally, a liquid developer for electrostatic photography comprises a carrier liquid having a high electric resistance ($10^9$ to $10^{15}$ Ω.cm), positively or negatively charged toner particles, a fixing resin for giving fixability to the toner particles, a dispersant for dispersing stably the toner particles, a charge-controlling agent for charging the toner particles positively or negatively, and various additives. A charge-controlling agent gives positive or negative distinct charge polarity to toner particles; it also controls the charged amount, and is an essential component for liquid developers.

Since the charge of toner particles greatly influences the image obtained after the development processing, strong efforts are made to control the charge stably. To adjust the charge, roughly classified, two methods are known. The first method comprises covering the surface of toner particles with a material that can be ionized or that can adsorb ions. As the material used for this purpose, oils and fats, such as linseed oil and soybean oil, alkyd resins, halogenated polymers, aromatic carboxylic acids disclosed in JP-B ("JP-B" means examined Japanese patent publication) No. 5944/1976, acid group-containing water-soluble dyes disclosed in JP-B No. 12869/1981, and oxidized condensates of aromatic polyamines disclosed in JP-A ("JP-A" means unexamined published Japanese patent application) No. 120629/1975 are known. Further, for example, pigment-/polymer compositions (e.g., grafted carbon) which are obtained by polymerizing a polar monomer in the presence of a pigment and are disclosed in JP-B Nos. 6157/1971, 6151/1971, and 13584/1976, and a polymer electrolyte disclosed in JP-B No. 6354/1978, are known. In this method, since the toner particles themselves have polar groups, the amount of the ion component contained in the carrier liquid can be reduced to produce a developer good in image quality, but there are such problems as that it is difficult to adjust the charged amount finely and that a change of the charged amount with the lapse of the time is conspicuous in some cases of substances used.

The second method allows a substance to be present which dissolves in a carrier liquid and can transfer ions to or from toner particles. As examples of such a substance, a metal naphthenate, such as nickel naphthenate and cobalt naphthenate; a metal soap, such as cobalt 2-ethylhexanoate; a metal sulfonate, such as calcium dodecylbenzenesulfonate, a petroleum-type metal sulfonate, and a metal salt of a sulfosuccinate; a lecithin; a polyvinylpyrrolidone resin; a polyamide resin; a sulfonic acid-containing resin described in JP-B No. 24944/1981; and a hydroxybenzoic acid derivative described in JP-A No. 139753/1982, are known. Quaternary ammonium soluble copolymers described in JP-A Nos. 31739/1979, 137960/1984, and 39059/1986; a metal salt such as a nickel salt of an amino acid derivative, described in JP-A No. 50951/1986; a semialkylamide compound of a diisobutylene/maleic acid copolymer described in JP-B No. 26596/1974: and itaconic anhydride derivatives and hemi-maleic acid amides described in JP-A Nos. 173558/1985, 179750/1985, and 182447/1985, are also known.

Although the second method is generally used, since the charged amount is easily controlled by a charge-controlling substance, the electric resistance of the liquid developer is apt to be lowered because the added charge-controlling substance is generally liable to be ionized. As a result, the optimum amount of charge-controlling substance to be added is restricted extremely, and when the added amount exceeds the optimum amount, such adverse effects as a decrease of the image density and flow-out of the image occur. On the other hand, if the amount of the charge-controlling substance to be added is small, there arises the problem that collapse of shadow details of dots and fringes surrounding the image (leading to the occurrence of doublets) occur. In this case, it becomes an important technique for the charged amount to be increased without increasing the amount to be added. Further, when many sheets are developed, the concentration of the charge-controlling agent changes or the definition of the image changes. Furthermore, after the liquid developer is prepared, in some cases, the magnitude of the charge changes with time, to adversely affect the image quality or to increase the settling of the toner particles. Further, there are even some substances that denature due to oxidation or the like during storage and lose charge-controllability.

Generally, toner particles contain a colorant, such as a pigment and a dye, in order to make the image visible. It is known that the charge of the toner particles is noticeably influenced by some kinds of these colorants, and also that the charging ability of the colorant is used to charge toner particles. On the other hand, in an application wherein only ink adhesion is required, such as for printing plates, or when the toner image section is used as a resist and the non-image area is dissolved out to produce a printing plate, a colorant is not necessarily required, and it is rather desirable not to contain a colorant because a colorant soils a printed product or lowers the resist property. Toner particles not containing a colorant, that is, toner particles mainly consisting of a polymer, are difficult to be charged and, for example, polar groups are generally introduced to the polymer particles. In this case, the polymer particles are attended with the same problems as those of the first method.

SUMMARY OF THE INVENTION

The first object of the present invention is to provide a positively charged liquid developer improved in the problems possessed by the charge-controlling agents of the conventional liquid developers as mentioned above, and in particular a liquid developer wherein the charged amount can be increased without increasing the amount of a charge-controlling agent.

The second object of the present invention is to provide a liquid developer that causes no flow-out of images and no double image and that is excellent in image quality, such as reproduction of halftone dots.

The third object of the present invention is to provide a liquid developer comprising polymer particles as a major component and a charge-controlling agent suitable for said liquid developer, to be used, for example, for a printing plate or a photomechanical printing plate that will be produced by dissolving out a non-image area using an image section as a resist.

Other and further objects, features and advantages of the invention will appear more evident from the following description.

DETAILED DESCRIPTION OF THE INVENTION

To attain the above objects, the inventors have paid attention to the second method of charge-controlling and have keenly studied it, and they have discovered a liquid developer composition that solves the above problems.

That is, the present invention has attained the above objects by providing:

1. A liquid developer for electrostatic photography, which comprises, in a nonaqueous solvent having an electric resistance of $10^9$ Ω.cm or over and a dielectric constant of 3.5 or below, a toner containing at least a resin, a charge-controlling agent resin or a charge-controlling agent, and an acid group-containing polymer soluble in said nonaqueous solvent.

2. A liquid developer for electrostatic photography as stated in 1, wherein said charge-controlling agent resin is a copolymer, which is a reaction product of a polymer made up of maleic anhydride and at least one monomer that can be polymerized to form a polymer soluble in said nonaqueous solvent, with a primary amino compound or a mixture of a primary amino compound and a secondary amino compound, and which contains hemi-maleic acid amide components and maleinimide components as repeating units.

3. A liquid developer for electrostatic photography as stated in 1, wherein said charge-controlling agent is a metal soap soluble in said nonaqueous solvent.

4. A liquid developer for electrostatic photography, which comprises, in a nonaqueous solvent having an electric resistance of $10^9$ Ω.cm or over and a dielectric constant of 3.5 or below, a toner containing at least a resin, a charge-controlling agent, and a quaternary ammonium salt.

5. A liquid developer for electrostatic photography as stated in 4, wherein said charge-controlling agent is a metal soap soluble in said nonaqueous solvent.

6. A liquid developer for electrostatic photography as stated in 4, wherein said charge-controlling agent is a copolymer, which is a reaction product of a polymer made up of maleic anhydride and at least one monomer that can be polymerized to form a polymer soluble in said nonaqueous solvent, with a primary amino compound or a mixture of a primary amino compound and a secondary amino compound, and which contains hemi-maleic acid amide components and maleinimide components as repeating units.

7. A liquid developer for electrostatic photography, which comprises, in a nonaqueous solvent having an electric resistance of $10^9$ Ω.cm or over and a dielectric constant of 3.5 or below, a toner containing at least a resin, a charge-controlling agent, a quaternary ammonium salt, and an acid group-containing polymer soluble in said nonaqueous solvent.

8. A liquid developer for electrostatic photography as stated in 7, wherein said charge-controlling agent is a metal soap soluble in said nonaqueous solvent.

9. A liquid developer for electrostatic photography as stated in 7, wherein said charge-controlling agent is a copolymer, which is a reaction product of a polymer made up of maleic anhydride and at least one monomer that can be polymerized to form a polymer soluble in said nonaqueous solvent, with a primary amino compound or a mixture of a primary amino compound and a secondary amino compound, and which contains hemi-maleic acid amide components and maleinimide components as repeating units.

The present invention will now be described in detail.

As the charge-controlling agent resin to be used in the present invention, a copolymer can be mentioned which is a reaction product of a polymer made up of maleic anhydride and at least one monomer that can be polymerized to form a polymer soluble in a nonaqueous solvent having an electric resistance of $10^9$ Ω.cm or over and a dielectric constant of 3.5 or below, with a primary amino compound or a mixture of a primary amino compound and a secondary amino compound, and contains hemi-maleic acid amide components and maleinimide components as repeating units. This copolymer is at least a terpolymer made up of a copolymer having hemi-maleic acid amide components and maleinimide components, and a polymer component that imparts solubility to the copolymer in a carrier.

The monomer of the polymer that imparts solubility includes, for example, polymerizable alkenes, cycloalkenes, styrenes, vinyl ethers, ally ethers, carboxylates, and acrylates. In particular, the monomer includes, for example, substituted or unsubstituted alkenes having a total carbon number of 3 to 40 (e.g., propenylene, butene, vinylidene chloride,ω-phenyl-1-propene, allyl alcohol, hexene, octene, 2-ethylhexene, decene, dodecene, tetradecene, hexadecene, octadecene, docosene, eicosene, and hexyl 10-undecenate), cycloalkenes having a total carbon number of 5 to 40 (e.g., cyclopentene, cyclohexene, and bicyclo[2,2,1]-heptene-2,5-cyanobicyclo[2,2,1]-heptene-2]), substituted or unsubstituted styrenes having a total carbon number of 10 to 40 (e.g., 4-ethylstyrene, 4-butylstyrene, 4-n-octylstyrene, and 4-hexyloxystyrene), aliphatic group-substituted vinyl ethers or ally ethers having a total carbon number of 1 to 40 [examples of the aliphatic group are substituted or unsubstituted alkyl groups (e.g., methyl, ethyl, butyl, hexyl, octyl, decyl, dodecyl, hexadecyl, octadecyl, docosanyl, 2-ethylhexyl, and 4-methoxybutyl), substituted or unsubstituted aralkyl groups (e.g., benzyl and phenetyl), substituted or unsubstituted cycloalkyl groups (e.g., cyclopentyl and cyclohexyl), and substituted or unsubstituted alkenyl groups (e.g., 2-pentenyl, 4-propyl-2-pentenyl, oleyl, and linoleyl)], aromatic group-substituted vinyl ethers or ally ethers having a total carbon number of 6 to 40 (examples of the aromatic group are phenyl, 4-butoxyphenyl, and 4-octylphenyl), vinyl esters or ally esters of substituted or unsubstituted aliphatic carboxylic acid having a total carbon number of 2 to 40 (e.g., esters of acetic acid, valeric acid, caproic acid, capric acid, lauric acid, myristic acid, oleic acid, sorbic acid, and linolic acid), vinyl esters or ally esters of aromatic carboxylic acids having a total carbon number of 6 to 32 (e.g., esters of benzoic acid, 4-butylbenzoic acid, and 4-hexylbenzoic acid), and substituted or unsubstituted aliphatic group-containing esters having a total carbon number of 1 to 32 of an unsaturated carboxylic acid, such as acrylic acid, methacrylic acid, maleic acid, and crotonic acid (e.g., methyl, ethyl, propyl, hexyl, decyl, 2-hydroxyethyl, and N,N-dimethylaminoethyl esters).

Among these, alkenes having 10 or more carbon atoms, preferably 10 to 24 carbon atoms, vinyl ethers, acrylic acids and methacrylic acids can be mentioned as preferable ones.

Specific examples of the copolymer (an intermediate of the charge-controlling agent resin) of maleic anhydride with these monomers are shown below, but the present invention is not restricted to these compounds.

Example of intermediate of charge-controlling agent resin (Copolymerization ratio is shown in weight ratio)

(1)
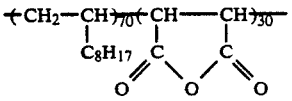

(2)
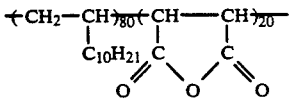

(3)
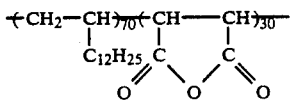

(4)
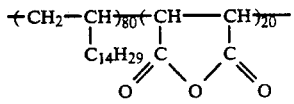

(5)
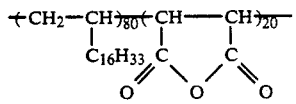

(6)
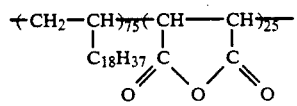

(7)
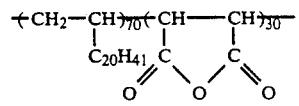

(8)
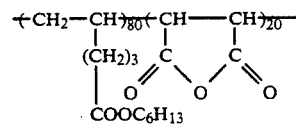

(9)
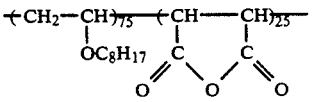

(10)
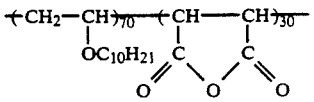

(11)
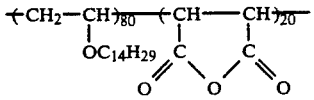

(12)
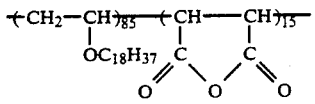

-continued

Example of intermediate of charge-controlling agent resin (Copolymerization ratio is shown in weight ratio)

(13)
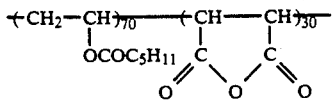

(14)
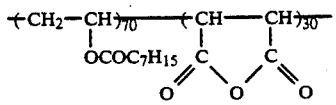

(15)
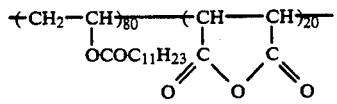

(16)
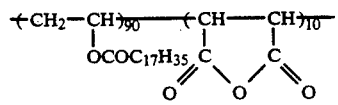

(17)
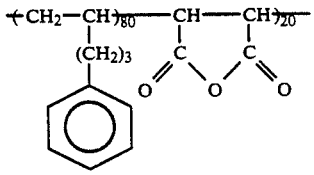

(18)
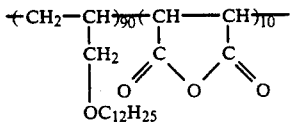

(19)
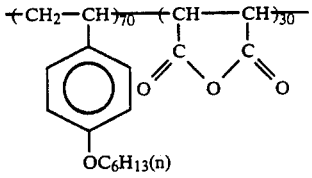

(20)
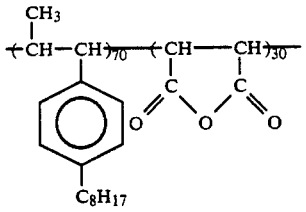

(21)
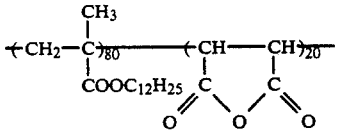

The copolymers containing maleic anhydride can be produced in conventionally known manners as described, for example, in detail in *Kindai Koqvokaoaku*, Vol. 16, Kobunshi Kogyokagaku I, the first volume, edited by Ryohei Oda, page 281 (published by Asakura-shoten), and in known literatures cited in the general remarks in the Second Chapter of *Polymer Handbook*, 2nd. Edition, by Brandrup, John Wiley & Sons, New York.

The compound used in the present invention is a reaction product of the above copolymer containing maleic anhydride with an amino compound, and as the amino compound, a primary amino compound represented by the following formula (I), or a combination of a primary amino compound represented by formula (I) with a secondary amino compound represented by the following formula (II), can be used:

$$R_1NH_2 \qquad \text{formula (I)}$$

$$NH(R_1)(R_2) \qquad \text{formula (II)}$$

wherein $R_1$ and $R_2$, which may be the same or different, each represent an aliphatic group, a cycloaliphatic hydrocarbon group, an aromatic group, or a heterocyclic group, and preferably represent an substituted or unsubstituted alkyl group having 1 to 32 carbon atoms (e.g., methyl, ethyl, butyl, hexyl, octyl, decyl, dodecyl, hexadecyl, octadecyl, docosanyl, 2-ethylhexyl, 4-butoxybutyl, and N,N-dibutylaminopropyl), a substituted or unsubstituted alkenyl group having 3 to 32 carbon atoms (e.g., allyl, 2-pentenyl, 4-propyl-2-pentenyl, decenyl, oleyl, and linoleyl), a substituted or unsubstituted aralkyl group having 7 to 36 carbon atoms (e.g., benzyl and phenethyl), a substituted or unsubstituted cycloaliphatic hydrocarbon group having 5 to 32 carbon atoms (e.g., cyclopentyl, cyclohexyl, bicyclo[2,2,1]-heptyl, and cyclohexenyl), a substituted or unsubstituted aryl group having 6 to 38 carbon atoms (e.g., phenyl, tolyl, 4-butylphenyl, 4-decylphenyl, and 4-butoxyphenyl), or a heterocyclic group having 5 to 18 carbon atoms (e.g., furyl and thienyl). In formula (II), $R_1$ and $R_2$ may bond together through the carbon atoms to form a closed ring, which may contain a heteroatom (e.g., morpholyl).

Examples of the amino compound include ethylamine, propylamine, butylamine, pentylamine, hexylamine, octylamine, decylamine, dodecylamine, tetradecylamine, hexadecylamine, stearylamine, docosanylamine, 2-ethylhexylamine, 3,3-dimethylpentylamine, cyclohexylamine, allylamine, benzylamine, and 4-n-octylaniline, with preference given to an amine having an alkyl group with 8 or more carbon atoms, preferably 8 to 22 carbon atoms, but the present invention is not limited to them.

The polymer compound (charge-controlling resin), which is the reaction product of the intermediate of the charge-controlling agent resin with the amino compound, is characterized by containing hemi-maleic acid amide components and maleinimide components, and it can be easily produced by a macromolecular reaction of the maleic anhydride component corresponding to that of the polymer compound with a primary amino compound, and then carrying out a dehydration ring-closing reaction, to convert part of the hemi-maleic acid amide copolymer to maleinimide components.

That is, the carboxylic anhydride and the amino compound are mixed in an organic solvent that will not react with these compounds and that can dissolve them at the below-mentioned reaction temperature [e.g., hydrocarbons (e.g., decane, "Isopar G", "Isopar H", cyclohexane, toluene, and xylene), ketones (e.g., methyl ethyl ketone and methyl isobutyl ketone), ethers (e.g., dioxane, tetrahydrofuran, and anisole), halogenated hydrocarbons (e.g., chloroform, dichloroethylene, and methyl chloroform), dimethylformamide, and dimethyl sulfoxide, which may be used alone or as a mixture of two or more], and they are reacted at a reaction temperature of 60 to 200° C., preferably 100 to 180° C., for 1 to 80 hours, preferably 3 to 15 hours. In this reaction, when a catalytic amount of an organic base, an inorganic acid, or an organic acid is used, the reaction is facilitated. Further, a common dehydrating agent can be used additionally. The reaction product obtained by this reaction is a polymer compound containing hemi-maleic acid amide components and maleinimide components as described above, and the ratio of the hemi-maleic acid amide components present therein to the maleinimide components is 10:90 to 90:10, preferably 30:70 to 70:30. The weight ratio of the monomer part capable of forming the polymer soluble in nonaqueous solvents to the maleic acid anhydride part is 10:90 to 99.5:0.5, preferably 70:30 to 30:70. The weight of the polymer compound is 1,000 to 300,000, preferably 3,000 to 100,000, on the weight average in terms of polystyrene measured by GPC.

As examples of the charge-controlling agent resin, the reaction product of the following exemplified compound (1) as an intermediate with n-octadecylamine, the reaction product of the following exemplified compound (2) as an intermediate with n-hexadecylamine, the reaction product of the following exemplified compound (4) as an intermediate with n-octylamine, and the reaction product of the following exemplified compound (5) as an intermediate with 2-ethylhexylamine, can be mentioned, but the present invention is not restricted to them.

The acid group-containing polymer soluble in the nonaqueous solvent is a polymer or a copolymer of a monomer having an acid group, such as a carboxyl group, a sulfo group, and a phosphonic group, with a carboxyl group being used preferably. As the monomer having a carboxyl group, one represented by the following formula (III) can be mentioned:

$$CH(R_3)=CR_4(COOH) \qquad \text{formula (III)}$$

wherein $R_3$ and $R_4$, which may be the same or different, each represent a hydrogen atom, a halogen atom, a nitryl group, a carboxyl group, an alkyl group having 1 to 3 carbon atoms, a substituted or unsubstituted phenyl group, $-COOR_5$, $-CHCOOR_5$, or $-NHCOR_5$ in which $R_5$ represents a substituted or unsubstituted alkyl group having 1 to 18 carbon atoms, an alkenyl group, a cycloaliphatic group, or an aryl group). As examples of the monomer, acrylic acid, methacrylic acid, α-ethylacrylic acid, α-chloroacrylic acid, α-bromoacrylic acid, α-acetoamidoacrylic acid, α-phenylacrylic acid, α-phenylacetamidoacrylic acid, crotonic acid, cinnamic acid, itaconic acid, maleic acid, and fumaric acid can be mentioned, with acrylic acid and methacrylic acid being used preferably. These monomers having an acid group are copolymerized with a monomer that will form the polymer soluble in nonaqueous solvents to make the polymer soluble as a whole in the nonaqueous solvents. As examples of this monomer, the monomers capable of forming the polymer soluble in nonaqueous solvents listed for the charge-controlling agent resin can be mentioned. Examples of the acid group-containing polymer are given below, but the present invention is not restricted to them.

Example of acid group-containing polymer
(Copolymerization ratio is shown in weight ratio)

(1) 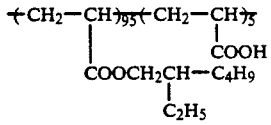

(2) 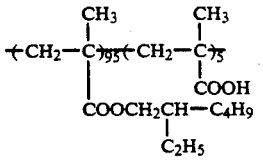

(3) 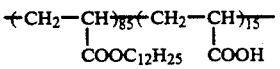

(4) 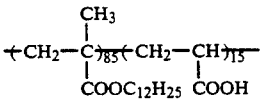

(5) 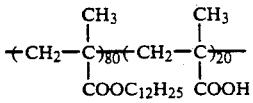

(6) 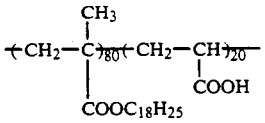

(7) 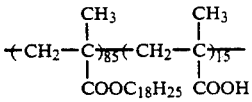

(8) 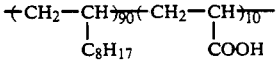

(9) 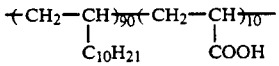

(10) 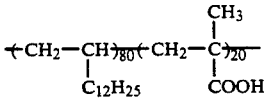

(11) 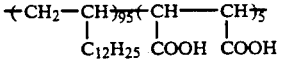

(12) 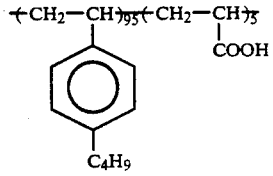

(13) 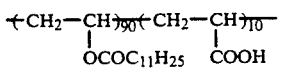

-continued

Example of acid group-containing polymer
(Copolymerization ratio is shown in weight ratio)

(14) 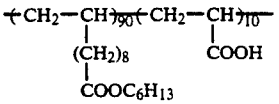

The weight ratio of the monomer part constituting the acid group-containing polymer and capable of forming the polymer soluble in nonaqueous solvents to the acid group-containing monomer is 10:90 to 99.9 to 1. The weight-average molecular weight of the polymer is 1,000 to 200,000, preferably 3,000 to 50,000, in terms of polystyrene as measured by GPC.

As the charge-controlling agent to be used in the present invention, metal soaps soluble in the carrier liquid can be mentioned. The term "a metal soap" means a compound whose cationic component is a monovalent or polyvalent metal component and whose anionic component is an organic acid component. The metal that constitutes the metal soap includes, for example, magnesium, calcium, strontium, barium, aluminum, gallium, titanium, zirconium, chromium, molybdenum, manganese, iron, cobalt, nickel, copper, zinc, tin, lead, cadmium, and silver.

The acid that constitutes the metal soap includes organic acids having an acid group, such as a carboxylic acid, an alkyl sulfuric acid, a sulfonic acid, and a phosphoric acid ester. As the carboxylic acid, carboxylic acids having 6 to 24 carbon atoms can be mentioned. As examples of the carboxylic acid, caproic acid, caprylic acid, 2-ethylhexanoic acid (octenoic acid), capric acid, lauric acid, tridecylic acid, myristic acid, pentadecylic acid, palmitic acid, margaric acid, stearic acid, 12-hydroxystearic acid, oleic acid, linolic acid, linolenic acid, naphthenic acid, resin acids, alkylphthalic acids, and alkylsalicylic acids can be mentioned; as examples of the alkylsulfonic acid, alkylsulfuric acid esters having 12 to 20 carbon atoms can be mentioned can be mentioned; as examples of the sulfonic acid, alkylbenzenesulfonic acids having 12 to 24 carbon atoms, such as dodecylbenzenesulfonic acid and octadecylbenzenesulfonic acid, and petroleum sulfonic acid can be mentioned; and as examples of the phosphoric acid ester, those having 8 to 20 carbon atoms and dialkylphosphoric acid esters can be mentioned. As examples of the metal soap, iron naphthenate, manganese naphthenate, nickel naphthenate, cobalt naphthenate, zirconium naphthenate, iron octenate, cobalt octenate, nickel octenate, zirconium octenate, aluminum tristearate, lead stearate, manganese oleate, copper oleate, resin acid lead salt, petroleum acid barium salt, and 2-ethylhexylsulfosuccinic acid manganese salt can be mentioned, but the present invention is not restricted to them.

The quaternary ammonium salt to be used in the present invention is represented by formula (IV):

formula (IV)

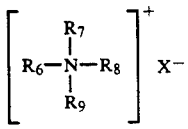

wherein $R_6$, $R_7$, $R_8$, and $R_9$ each represent a substituted or unsubstituted alkyl group having 1 to 32 carbon atoms (e.g., methyl, ethyl, butyl, hexyl, octyl, decyl, dodecyl, hexadecyl, octadecyl, docosanyl, 2-ethylhexyl, 4-butoxybutyl, and N,N-dibutylaminopropyl), a substituted or unsubstituted alkenyl group having 3 to 32 carbon atoms (e.g., allyl, 2-pentenyl, 4-propyl-2-pentenyl, decenyl, oleyl, and linoleyl), a substituted or unsubstituted aralkyl group having 7 to 36 carbon atoms (e.g., benzyl and phenethyl), a substituted or unsubstituted cycloaliphatic hydrocarbon group having 5 to 32 carbon atoms (e.g., cyclopentyl, cyclohexyl, bicyclo[2,2,1]-heptyl, and cyclohexenyl), a substituted or unsubstituted aryl group having 6 to 38 carbon atoms (e.g., phenyl, tolyl, 4-butylphenyl, 4-decylphenyl, and 4-butoxyphenyl), or a heterocyclic group having 5 to 18 carbon atoms (e.g., furyl and thienyl). As examples of the substituent, fluorine, chlorine, bromine, and iodine atoms, a hydroxyl group, a nitro group, a nitryl group, an amino group, an alkoxy group, a sulfo group, and a carboxyl group can be mentioned.

$R_6$, $R_7$, $R_8$, and $R_9$ may be the same or different and two of $R_6$, $R_7$, $R_8$, and $R_9$ may bond together to form a mononuclear ring system or a polynuclear ring system having 4 to 12 carbon atoms which may have 1 to 4 heteroatoms in the ring, may have 0 to 6 double bonds, and may be substituted by a halogen atom, an alkyl group having 1 to 6 carbon atoms, an alkoxy group having 1 to 6 carbon atoms, a hydroxyl group, or a nitro group.

$X^-$ represents an organic or inorganic anion. $R_6$, $R_7$, $R_8$, and $R_9$ may be substituted by a $-COO^{31}$ or $-SO_3^-$ group and in that case $X^-$ is not required.

As examples of $X^-$, an anion of a halogen atom (e.g., $Cl^-$, $Br^-$, and $I^-$) , $PF_6^-$, a sulfato, phosphato, cyanato, thiocyanato, $BF_4^-$, a B (aryl)$_4$ $^-$, (e.g., tetraphenyl borato, p-chlorotetraphenyl borato, and p-methyltetraphenyl borato), phenolato, nitrophenolato, a saturated or unsaturated aliphatic acid or aromatic carboxylate (e.g., acetate, lactate, benzoate, and salicylate), and a sulfonato (e.g., ethyl sulfonato, phenyl sulfonato, and p-toluenesulfonato) can be mentioned.

As these quaternary ammonium salts, preferable ones are those wherein the number of carbon atoms of the alkyl group small and that are insoluble or sparingly soluble in the carrier liquid.

Specific examples of the quaternary ammonium salt are given below, but the present invention is not restricted to them: tetramethylammonium chloride, tetramethylammonium, p-toluenesulfonate, tetramethylammonium tetraphenylborate, tetraethylammonium bromide, tetraethylammonium salicylate, tetra-n-propylammonium bromide, tetrabutylammonium bromide, tetrabutylammonium chloride, tetrabutylammonium phenylsulfonate, tetraoctylammonium iodide, cetyltrimethylammonium chloride, cetyldimethylethylammonium bromide, benzyltrimethylammonium chloride, butylpyrimidium bromide, laurylpyrimidium bromide, cetylpyrimidium chloride, 1-hexadecylpyrimidium bromide, and 2-dodecylisoquinolium bromide.

As the quaternary ammonium salt, a commercially available one can be used as it is or after purifying by recrystallization or the like, but it can be easily synthesized in conventional manner. For example, the quaternary ammonium salt can be synthesized by heating ammonia and an excess of an alkyl halide or a primary amine, a secondary amine, or a tertiary amine and an excess of an alkyl halide.

These quaternary ammonium salts may be added by dissolving or dispersing them in the carrier liquid used in the present liquid developer or by dissolving them in a solvent that can dissolve them. As the solvent, various alcohols, tetrahydrofuran, dimethyl sulfoxide, dioxane, and ethylene glycol ethers, such as methyl Cellosolve, can be mentioned, but the present invention is not restricted to them.

The present invention uses the above charge-controlling agent resin and the acid group-containing polymer in combination; the above charge-controlling agent resin or the charge-controlling agent, such as a metal soap, and the quaternary ammonium salt in combination; or the above charge-controlling agent resin or the charge-controlling agent, such as a metal soap, the quaternary ammonium salt, and the acid group-containing polymer in combination. Although the acid group-containing polymer or the quaternary ammonium salt used in the present invention itself does not serve as a charge-controlling agent, it has been found that when the acid group-containing polymer or the quaternary ammonium salt, or both of them, are used together with the above charge-controlling agent, the charge increases and a good image can be obtained in comparison with the case when the charge-controlling agent is used singly. Although it is unclear why such an effect takes place, it is considered that the acid group-containing polymer and the quaternary ammonium salt serve to assist the above charge-controlling agent.

The carrier liquid to be used in the liquid developer of the present invention is a nonaqueous solvent having an electric resistance of $10^9$ Ω.cm or over and a dielectric constant of 3.5 or below, preferably an electric resistance of $10^{10}$ Ω.cm or over and a dielectric constant of 3.0 or below; and, as an example, a solvent comprising at least one selected from the group consisting of straight-chain or branched chain aliphatic hydrocarbons, cycloaliphatic hydrocarbons, aromatic hydrocarbons, and their halogen-substituted products can be mentioned. Specifically, solvents selected, for example, from octane, isooctane, decane, isodecane, decalin, nonane, dodecane, isododecane, cyclohexane, isooctane, cyclodecane, toluene, xylene, mesitylene, "Isopar E", "Isopar G", "Isopar H", "Isopar L (Isopars are trade names and are manufactured by Exxon Co.)", "Shell Sol 70", "Shell Sol 71 (Shell Sols are trade names and are manufactured by Shell Oil Co.)", and "Amsco OMS", and "Amsco 460 solvent (Amscos are trade names and are manufactured by Spirits Co.)" are used alone or in combination.

As the toner to be used in the present invention, a specific toner is not designated and any conventional known toner can be used. As the resin which is the major component of the toner, any resin that is insoluble in the carrier liquid or swellable and substantially insoluble in the carrier liquid can be used and examples are synthetic or natural resins, such as polyethylene resins, ethylene/vinyl acetate resins, acrylic resins, methacrylic resins, styrene resins, carbonate resins, vinyl acetate resins, ester resins, amide resins, alkylene resins, phenol-modified alkyd resins, linseed oil-modified alkyd resins, epoxy resins, phenol formaldehyde resins, cumarone/indene resins, natural resin-modified maleic resins, vegetable oil polyamide resins, rosin resins, butadiene rubbers, styrene/butadiene rubbers, cyclized rubbers, and natural rubbers. Further, for example, acrylic resins and acrylic/styrene copolymer resins having resist-property, disclosed in JP-A Nos. 121047/1983, 127939/1983, 139155/1983, 162058/1986, 74957/1990, and 74958/1990, can be mentioned.

To enhance the dispersibility of developer of the present invention, a known dispersing agent can be used. Herein the term "dispersing agents" means resins that can be dissolved or swelled in the carrier liquid, that is, the nonaqueous solvent that is high in electric resistance and that is used in the developer of the present invention, and can enhance the dispersibility of toner particles, and examples thereof are synthetic rubbers, such as styrene/butadiene rubbers, vinyltoluene/-butadiene rubbers, and butadiene/isoprene rubbers; polymers of acrylic monomers having a long-chain alkyl group, such as 2-ethylhexyl methacrylate, lauryl methacrylate, and stearyl methacrylate; and random, graft, and block copolymers of these monomers with styrene, vinyltoluene, or the like.

As the colorant to be used in the present invention, any pigment or any dye conventionally used for liquid developers, or a combination of them, can be used. Examples of the colorant are Hansa Yellow (C.I. 11680), Benzidine Yellow (C.I. 21090), Benzidine Orange (C.I. 21110), Fast Red (C.I. 37085), Brilliant Carmine 3B (C.I. 16015-Lake), Phthalocyanine Blue (C.I. 74160), Phthalocyanine Green (C.I. 74260), Victoria Blue (C.I. 42595-Lake), Spirit Black (C.I. 50415), Oil Blue (C.I. 74350), Alkali Blue (C.I. 42770A), Fast Scarlet (C.I. 12315), Rhodamine 6B (C.I. 45160), Fast Sky Blue (C.I. 74200-Lake), Nigrosine (C.I. 50415), and carbon black. A pigment whose surface has been treated can also be used, such as carbon black dyed with Nigrosine and grafted carbon obtained by graft polymerization of a polymer.

Further, a bisarylazo derivative of 2,3-naphthalenediol described in JP-B No. 195157/1982, a formazan-dyed pigment described in JP-B No. 4440/1972, and lake pigments described, for example, in JP-B Nos. 1431/1976, 4912/1981, and 4911/1981 are also useful.

The developer of the present invention can be produced in conventionally known manner. Examples of the production method thereof are shown below.

First, a colorant comprising a pigment or a dye, or a combination of a pigment with a dye and a resin for forming the toner particles mentioned above, are dispersed and kneaded in a solvent having an affinity for the resin in a dispersing machine, such as a ball mill, a roll mill, and a paint shaker, and then the solvent is removed by heating, to obtain a kneaded product.

Optionally the kneaded product may be poured into a liquid that does not dissolve the resin, to obtain a mixture by resettling.

Alternatively, a colorant and a resin are kneaded by a kneading machine, such as a kneader and a three-roll mill, while heating them at a temperature higher than the melting point of said resin, followed by cooling, to obtain a mixture.

The thus obtained mixture is wet-ground together with a dispersing agent optionally after the mixture is dry-ground, thereby obtaining a toner concentrate. The solvent used in that wet-grinding may be a carrier liquid itself, or a combination of a carrier liquid with 1 to 20 wt % of a solvent having an affinity for the above resin, such as toluene and acetone. In the case of monomers, a monomer that can dissolve in a nonpolar solvent and that will become insoluble in said solvent when polymerized into a resin is polymerized to obtain a resin dispersed in said solvent, which is known as the so-called dispersion polymerization granulation method. The production can be effected by methods described, for example, by K.E.J. Barrett in *Dispersion Polymerization in Organic Media,* John Wiley and Sons, London, 1974, and in U.S. Pat. Nos. 3,637,569 and 3,753,760.

As a technique of coloring resin particles obtained by the dispersion polymerization granulation method, a method is present wherein a pigment or a dye is dispersed into the resin physically using a dispersing machine (e.g., a paint shaker, a colloid mill, an oscillating mill, and a ball mill), as described, for example, in JP-A No. 75242/1973, and there are a large number of pigments and dyes that are known to be used therein. Examples are magnetic iron oxide powder, carbon black, Nigrosine, Alkali Blue, Hansa Yellow Quinacridone Red, Phthalocyanine Blue, Phthalocyanine Black, and Benzidine Yellow.

Another technique for the coloration includes a method wherein a dispersed resin is dyed with a preferred dye by heating, as described, for example, in JP-A No. 48738/1982.

Examples are Hansa Yellow Crystal Violet, Victoria Blue, Malachite Green, Celliton Fast Red, Disperse Yellow, Disperse Red, Disperse Blue, and Solvent Red.

Still another technique for the coloration includes a method wherein a dispersed resin and a dye are chemically bonded. For example, a method wherein a resin and a dye are reacted as described, for example, in JP-A No. 54029/1978, and a method wherein a monomer that can be polymerized to form an insoluble dispersible resin is bonded to a dye previously, as described, for example, in JP-B No. 22955/1969, are known and can be used.

The developer of the present invention can be used for a photosensitive material that uses a known organic photoconductive material or inorganic photoconductive material. Further, the developer of the present invention can be used in developing an electrostatic latent image produced, for example, by means other than photosensitivity; that is, by charging a dielectric material by a charged needle.

As the organic photoconductive material, a wide variety of well-known organic photoconductive materials are present. Specific examples are substances described, for example, in the literature under the title of "Electrophotographic elements, materials, and processes" in *Research Disclosure,* No. 10938 (the May number, 1973), page 61, et seq.

Examples of practically used organic photoconductive materials are an electrophotographically sensitive material comprising poly-N-vinylcarbazole and 2,4,7-trinitrofluorene-9-one (U.S. Pat. No. 3,484,239), poly-N-vinylcarbazole sensitized with a pyrylium salt dye (JP-B No. 25658/1973), an electrophotographically sensitive material whose major component is an organic pigment (JP-A No. 37543/1974), and an electrophotographically sensitive material whose major component is a eutectic crystal complex comprising a dye and a resin (JP-A No. 10735/1972). Further, substances described in *Denshishashin Gakkai-shi,* Vol. 25, No. 2 (1986), pages 62 to 76, can be mentioned.

Typical inorganic photoconductive materials that can be used in the present invention are various inorganic compounds disclosed, for example, by R. M. Schaffert in *Electrophotography* (Focal Press (London), 1975), pages 260 to 374. As specific examples, zinc oxide, zinc sulfide, cadmium sulfide, selenium, a selenium/tellurium alloy, a selenium/arsenic alloy, and a selenium/tellurium/arsenic alloy can be mentioned.

Further, amorphous silicon can be mentioned.

The amounts of the components of the present liquid developer are shown below.

The amount of the toner particles whose major component is a resin and/or a colorant is 0.1 to 50 parts by weight, preferably 0.3 to 20 parts by weight, per 1,000 parts by weight of the carrier liquid. The amount of the dispersing agent is 0.1 to 100 parts by weight, preferably 0.5 to 50 parts by weight, per 1,000 parts by weight of the carrier liquid. The amount of the charge-controlling agent of the present invention is 0.0001 to 3 parts by weight, preferably 0.001 to 1 part by weight, the amount of the acid group-containing polymer is 0.0001 to 30 parts by weight, preferably 0.001 to 10 parts by weight, and the amount of the quaternary ammonium salt is 0.00001 to 10 parts by weight, preferably 0.0001 to 1 part by weight. The weight ratio of the charge-controlling agent to the acid group-containing polymer and the weight ratio of the charge-controlling agent to the acid group-containing polymer are 1:99 to 99:1. The order of the addition is such that the charge-controlling agent is added to the carrier liquid, to which the toner particles have been added; then the acid group-containing polymer is added, and a liquid having the quaternary ammonium salt dissolved or dispersed therein is added; but the present invention is not restricted to this.

The liquid developer of the present invention comprising a combination of a charge-controlling agent and an acid group-containing copolymer or a quaternary ammonium salt, and the liquid developer of the present invention comprising a combination of a charge-controlling agent, an acid group-containing copolymer, and a quaternary ammonium salt, can obtain a larger charge than that of liquid developers using a charge-controlling agent only, and therefore the present invention can provide a liquid developer excellent in charge properties and image quality.

The present invention is now described more specifically with reference to examples, but the present invention is not restricted to them as long as adherence is kept to the spirit of the invention.

Preparatory examples of intermediates of charge-controlling agent resins are described.

INTERMEDIATE PREPARATORY EXAMPLE 1: INTERMEDIATE SPECIFIC EXAMPLE (2)

A mixture of 105 g of maleic anhydride, 245 g of 1-dodecene, and 816 g of toluene was heated to 85° C. under a nitrogen atmosphere with stirring.

At that temperature, 6.0 g of benzoyl peroxide, an initiator, was added thereto, followed by stirring for 3 hours, and then a further 6.0 g of benzoyl peroxide was added, followed by stirring.

The solid content of the obtained polymer solution was 22.5%.

INTERMEDIATE PREPARATORY EXAMPLE 2: INTERMEDIATE SPECIFIC EXAMPLE (5)

A mixture of 98 g of maleic anhydride, 378 g of 1-octadecene, and 1850 g of toluene was heated to 90° C. under a nitrogen atmosphere with stirring.

At that temperature, 7.0 g of benzoyl peroxide was added thereto, followed by stirring for 3 hours, and then a further 7.0 g of benzoyl peroxide was added, followed by stirring.

The solid content of the obtained polymer solution was 14.8%.

INTERMEDIATE PREPARATORY EXAMPLE 3: INTERMEDIATE SPECIFIC EXAMPLE (15)

A mixture of 55 g of maleic anhydride, 129 g of vinyl laurate, and 430 g of methyl isobutyl ketone was heated to 80° C. under a nitrogen atmosphere with stirring. At that temperature, 2.4 g of benzoyl peroxide was added thereto, followed by stirring for 3 hours, and then a further 2.4 g of benzoyl peroxide was added, followed by stirring. After cooling, the obtained reaction solution was added to 3.0 liters of acetonitrile over 10 min with stirring and the stirring was continued for 30 min. The deposited solid was collected by filtering and dried under reduced pressure, to obtain 185 g of a white solid.

INTERMEDIATE PREPARATORY EXAMPLE 4: INTERMEDIATE SPECIFIC EXAMPLE (16)

A mixture of 49 g of maleic anhydride, 186 g of vinyl stearate, and 550 g of toluene was heated to 85° C. under a nitrogen atmosphere with stirring.

At that temperature, 4.0 g of benzoyl peroxide was added thereto, followed by stirring for 3 hours, and then a further 4.0 g of benzoyl peroxide was added, followed by stirring for 4 hours.

After cooling, the obtained reaction solution was added to 3.9 liters of acetonitrile over 10 min with stirring and the stirring was continued for 30 min.

The deposited solid was collected by filtering and dried under reduced pressure, to obtain 165 g of a white solid.

INTERMEDIATE PREPARATORY EXAMPLE 5: INTERMEDIATE SPECIFIC EXAMPLE (12)

A mixture of 49 g of maleic anhydride, 178 g of n-octadecyl vinyl ether, and 835 g of toluene was heated to 70° C. under a nitrogen atmosphere with stirring.

At that temperature, 2.1 g of 2,2'-azobisisobutyronitrile was added thereto, followed by stirring for 3 hours; then a further 2.1 g of 2,2'-azobis(isobutyronitrile) was added, the temperature was raised to 85° C., and the mixture was stirred for 4 hours. After cooling, the obtained reaction solution was added to 5.0 liters of acetonitrile over 10 min with stirring and the stirring was continued for 30 min. The deposited solid was collected by filtering and dried under reduced pressure, to obtain 167 g of a white solid.

Next, preparatory examples of charge-controlling agents are described.

PREPARATORY EXAMPLE (1)

A mixture of 100 g of the polymer solution obtained in Intermediate Preparatory Example 1, 23.2 g of n-octadecylamine, and 2 g of pyridine was stirred at a temperature of 100° C. for 8 hours. After cooling, the obtained reaction solution was added to 800 ml of methanol over 15 min with stirring and the stirring was continued for a further 1 hour.

The deposited solid was collected by filtering and dried under reduced pressure, to obtain 37 g of a pale yellowish white solid. The molecular weight was measured by high-performance liquid chromatography and was found to be 11,000. The result of the neutralization titration thereof with a potassium hydroxide/ethanol solution showed that the ratio of the hemi-maleic acid amide component to the maleinimide component was 6:4.

PREPARATORY EXAMPLE (2)

A mixture of 100 g of the polymer solution obtained in Intermediate Preparatory Example 2, 11.6 g of n-hexadecylamine, and 1.0 g of pyridine was heated and stirred for 6 hours under reflux. After cooling, the obtained solution was added to 600 ml of methanol over 15 min with stirring and the stirring was continued for a further 15 min. The deposited solid was collected by filtering and dried under reduced pressure, to obtain 22.6 g of a pale whitish yellow solid.

The molecular weight was measured by high-performance liquid chromatography and was found to be 7,000. The result of the neutralization titration thereof showed that the ratio of the hemi-maleic acid amide component to the maleinimide component was 50:50.

PREPARATORY EXAMPLE (3)

A mixture of 100 g of the polymer solution obtained in Intermediate Preparatory Example 2, 4.0 g of N-methyl-octadecylamine, and 1.5 g of pyridine was heated to a temperature of 100° C. and stirred for 100 hours. Thereafter, 1.8 g of n-hexylamine was added, followed by stirring at that temperature for 8 hours. After cooling, the obtained solution was added to 1 liter of methanol over 15 min with stirring and the stirring was continued for a further 1 hour. The deposited solid was collected by filtering and dried under reduced pressure, to obtain 17.5 g of a pale yellow solid.

The molecular weight was measured by high-performance liquid chromatography and was found to be 7,000. The result of the neutralization titration thereof showed that the ratio of the hemi-maleic acid amide component to the maleinimide component was 7:3.

PREPARATORY EXAMPLE (4)

A mixture of 27 g of the white solid obtained in Intermediate Preparatory Example 4, 13 g of n-octylamine, 0.8 g of pyridine, and 100 g of dioxane was stirred at a temperature of 110° C. for 6 hours. After cooling, the mixture was added to 1 liter of methanol over 15 min with stirring and the stirring was continued for a further 1 hour.

The deposited solid was collected by filtering and dried under reduced pressure, to obtain 34 g of a pale whitish yellow solid. The molecular weight was measured by high-performance liquid chromatography and was found to be 17,000. The result of the neutralization titration thereof showed that the ratio of the hemi-maleic acid amide component to the maleinimide component was 7:3.

PREPARATORY EXAMPLE (5)

A mixture of 39.4 g of the solid obtained in Intermediate Preparatory Example 5, 26.9 g of n-octadecylamine, 1.5 g of pyridine, and 100 g of xylene was stirred at a temperature of 120° C. for 5 hours. After cooling, the mixture was charged to 1.0 liter of methanol over 15 min with stirring and the stirring was continued for a further 1 hour. The deposited solid was collected by filtering and dried under reduced pressure, to obtain 57 g of a pale whitish yellow solid.

The molecular weight was measured by high-performance liquid chromatography and was found to be 19,000. The result of the neutralization titration thereof showed that the ratio of the hemi-maleic acid amide component to the maleinimide component was 4:6. The molecular weights in the above examples are on weight average in terms of polystyrene.

Now, Preparatory Examples of acid group-containing polymers are described.

PREPARATORY EXAMPLE (6) POLYMER EXAMPLE (2)

A mixture of 166 g of 2-ethylhexyl acrylate, 7.2 g of acrylic acid, and 400 g of "Isopar H" was heated to a temperature of 70° C. under a nitrogen atmosphere with stirring. At that temperature, 2 g of 2,2'-azobis-(isobutyronitrile) was added, and after the reaction was effected for 4 hours, a further 2 g of 2,2'-azobisisobutyronitrile was added; then the temperature was elevated to 80° C. and the reaction was effected for 4 hours. A viscous reaction liquid was obtained. The molecular weight was measured by GPC and was found to be 85,000 on weight average in terms of polystyrene.

PREPARATORY EXAMPLE (7): POLYMER EXAMPLE (13)

A mixture of 204 g of vinyl laurate, 7.2 g of acrylic acid, and 500 g of "Isopar H" was heated to a temperature of 70° C. under a nitrogen atmosphere with stirring. At that temperature, 2.1 g of 2,2'-azobis(isobutyronitrile) was added, and after the reaction was effected for 5 hours, a further 2.1 g of 2,2'-azobisisobutyronitrile was added; then the temperature was elevated to 85° C. and the reaction was effected for 3 hours. A viscous pale yellow liquid was obtained. The molecular weight was measured by GPC and was found to be 78,000 on weight average in terms of polystyrene.

EXAMPLES 1 TO 3

A mixed solution of 20 g of a graft copolymer (which is a resin for dispersion-stabilizing and has a weight ratio of methacrylic acid to stearyl methacrylate of 20/80) wherein the backbone is made of methyl methacrylate and the branches are made of stearyl methacrylate, 80 g of methyl methacrylate, 20 g of n-butyl methacrylate, and 400 g of "Isopar H" was heated to 60° C. under a flow of nitrogen with stirring. Then, 3.0 g of 2,2'-azobis(2,4-dimethylvaleronitrile) was added and the reaction was effected for 6 hours, thereby obtaining a latex dispersion having an average particle diameter of 0.22 μm (measured by a centrifugal transmission-type particle size measuring device, CAPA-700, manufactured by Horiba, Ltd.).

This latex dispersion and additives of the present invention were mixed in ratios given below to prepare comparative liquid developers and positively charged liquid developers of the present invention.

| | |
|---|---|
| Comparative liquid developer (A-1): | |
| 1. Latex dispersion | 30 g |
| 2. Isopar G | 720 g |
| Comparative liquid developer (A-2): | |
| 1. Latex dispersion | 30 g |
| 2. Isopar G solution containing 10% of the compound of acid group-containing polymer Example (2) | 10 g |
| 3. Isopar G | 710 g |
| Comparative liquid developer (A-3): | |
| 1. Latex dispersion | 30 g |
| 2. Isopropyl alcohol solution containing 1% of tetrabutylammonium bromide | 1 g |
| 3. Isopar G | 719 g |
| Comparative liquid developer (A-4): | |
| 1. Latex dispersion | 30 g |

-continued

| | |
|---|---|
| 2. Isopar G solution containing 1% of the charge-controlling agent resin of Preparatory Example (1) | 5 g |
| 3. Isopar G | 715 g |
| Example 1 | |
| Liquid developer (B): | |
| 1. Latex dispersion | 30 g |
| 2. Isopar G solution containing 1% of the charge-controlling agent resin of Preparatory Example (1) | 5 g |
| 3. Isopar G solution containing 10% of the compound of acid group-containing polymer Example (2) | 10 g |
| 4. Isopar G | 705 g |
| Example 2 | |
| Liquid developer (C): | |
| 1. Latex dispersion | 30 g |
| 2. Isopar G solution containing 1% of the charge-controlling agent resin of Preparatory Example (1) | 5 g |
| 3. Isopropyl alcohol solution containing 1% of tetrabutylammonium bromide | 1 g |
| 4. Isopar G | 714 g |
| Example 3 | |
| Liquid developer (D): | |
| 1. Latex dispersion | 30 g |
| 2. Isopar G solution containing 1% of the charge-controlling agent resin of Preparatory Example (1) | 5 g |
| 3. Isopropyl alcohol solution containing 1% of tetrabutylammonium bromide | 1 g |
| 4. Isopar G solution containing 10% of the compound of acid group-containing polymer Example (2) | 10 g |
| 5. Isopar G | 704 g |

The polarity of the liquid developers was checked by electrodeposition method and the charge was measured by a development property measuring device described in JP-B No. 696/1989 (the applied voltage was 500 V and the initial value of a change of time of the voltage induced in the back of the applied electrode was measured). The electric resistance and the electric constant of Isopar G were about $10^{15}$ Ω.cm and about 2.3.

| | Polarity | Charge |
|---|---|---|
| Comparative liquid developer (A-1) | both plus and minus | 1 mv/sec |
| Comparative liquid developer (A-2) | plus | 4 mv/sec |
| Comparative liquid developer (A-3) | plus | 5 mv/sec |
| Comparative liquid developer (A-4) | plus | 28 mv/sec |
| Liquid developer (B) of Example 1 | plus | 53 mv/sec |
| Liquid developer (C) of Example 2 | plus | 105 mv/sec |
| Liquid developer (D) of Example 3 | plus | 125 mv/sec |

All of Liquid developers (B), (C), and (D) of the present invention which comprise a combination of a charge-controlling agent and an acid group-containing polymer, a combination of a charge-controlling agent and a quaternary ammonium salt, and a combination of a charge-controlling agent, an acid group-containing polymer, and a quaternary ammonium salt respectively were greater in charge and more excellent in charge properties than Comparative liquid developers wherein the combinations of the components are different from those of the former developers. On the other hand, Comparative liquid developers (A-1 to A-3) containing no charge-controlling agent was small in charge and the charge could not be controlled.

EXAMPLES 4 TO 6

Similarly to Examples 1 to 3, using the latex dispersion used in Examples 1 to 3, liquid developers and Comparative liquid developers were prepared.

| | |
|---|---|
| Comparative liquid developer (E): | |
| 1. Latex dispersion of Example 1 | 30 g |
| 2. Isopar G solution containing 1% of the charge-controlling agent resin of Preparatory Example (2) | 5 g |
| 3. Isopar G | 715 g |
| Example 4 | |
| Liquid developer (F): | |
| 1. Latex dispersion of Example 1 | 30 g |
| 2. Isopar G solution containing 1% of the charge-controlling agent resin of Preparatory Example (2) | 5 g |
| 3. Isopar G solution containing 10% of the acid group-containing polymer (6) | 20 g |
| 4. Isopar G | 695 g |
| Example 5 | |
| Liquid developer (G): | |
| 1. Latex dispersion of Example 1 | 30 g |
| 2. Isopar G solution containing 1% of the charge-controlling agent resin of Preparatory Example (2) | 5 g |
| 3. Isopropyl alcohol solution containing 1% of cetylpyridinium chloride | 4 g |
| 4. Isopar G | 711 g |
| Example 6 | |
| Liquid developer (H): | |
| 1. Latex dispersion of Example 1 | 30 g |
| 2. Isopar G solution containing 1% of the charge-controlling agent resin of Preparatory Example (2) | 5 g |
| 3. Isopropyl alcohol solution containing 1% of cetylpyridinium chloride | 4 g |
| 4. Isopar G solution containing 10% of the acid-group containing polymer (6) | 20 g |
| 5. Isopar G | 691 g |

The polarity and charge of the liquid developers were checked in the same manner as Example 1.

| | Polarity | Charge |
|---|---|---|
| Comparative liquid developer (E) | plus | 31 mv/sec |
| Liquid developer (F) of Example 4 | plus | 65 mv/sec |
| Liquid developer (G) of Example 5 | plus | 105 mv/sec |
| Liquid developer (H) of Example 6 | plus | 120 mv/sec |

All of Liquid developers of the present invention which comprise a combination of a charge-controlling agent and an acid group-containing polymer or a quaternary ammonium salt, and a combination of above three were greater in charge and more excellent in charge properties compared with a developer containing a charge-controlling agent only.

EXAMPLE 7

Similarly to Example 1, using the latex dispersion used in Examples 1 to 3, liquid developers and Comparative liquid developers were prepared.

| | |
|---|---|
| Comparative liquid developer (I): | |
| 1. Latex dispersion of Example 1 | 30 g |
| 2. Isopar G solution containing 1% of zirconium naphthenate | 1 g |
| 3. Isopar G | 719 g |
| Liquid developer (J): | |
| 1. Latex dispersion of Example 1 | 30 g |
| 2. Isopar G solution containing 1% of | 1 g |

-continued

| | |
|---|---|
| zirconium naphthenate | |
| 3. Isopar G solution containing 1% of tetrahexyl ammonium bromide | 3 g |
| 4. Isopar G | 716 g |

The polarity and charge of the liquid developers were checked in the same manner as Example 1.

| | Polarity | Charge |
|---|---|---|
| Comparative liquid developer (I) | plus | 32 mv/sec |
| Liquid developer (J) | plus | 128 mv/sec |

Liquid developer of the present invention which comprise a combination of a charge-controlling agent and a quaternary ammonium salt was greater in charge and more excellent in charge properties compared with a developer containing a charge-controlling agent only.

EXAMPLES 8 TO 11

Liquid developers (K), (L), (M), and (N) were prepared in the same manner as Example 6, except that the charge-controlling agent, quaternary ammonium salt, and the acid group-containing resin were changed to those shown below. These substances were used in the same amount as those in Example 6. For comparison, comparative liquid developers each containing the charge-controlling agent only were prepared. Thus prepared liquid developers were checked the polarity and charge in the same manner as Example 1.

EXAMPLE 8

Liquid Developer (K)

Charge-controlling agent resin of Preparatory Example (2)
Tetra-n-propyl ammonium chloride
Acid-group containing polymer of Example (2)

EXAMPLE 9

Liquid Developer (L)

Charge-controlling agent resin of Preparatory Example (3)
Tetra-n-propyl ammonium chloride
Acid-group containing polymer of Example (3)

EXAMPLE 10

Liquid Developer (M)

Charge-controlling agent resin of Preparatory Example (4)
Tetra-n-propyl ammonium chloride
Acid-group containing polymer of Example (13)

EXAMPLE 11

Liquid Developer (N)

Charge-controlling agent resin of Preparatory Example (5)
Tetra-n-propyl ammonium chloride
Acid-group containing polymer of Example (10)

Polarity and charge of the liquid developers of Examples 8 to 11 were checked in the same manner as Example 1.

| | Polarity | Charge |
|---|---|---|
| Liquid developer (K) of Example 8 | plus | 105 mv/sec |

-continued

| | Polarity | Charge |
|---|---|---|
| Comparative liquid developer (the charge-controlling agent only) | plus | 40 mv/sec |
| Liquid developer (L) of Example 9 | plus | 125 mv/sec |
| Comparative liquid developer (the charge-controlling agent only) | plus | 38 mv/sec |
| Liquid developer (M) of Example 10 | plus | 132 mv/sec |
| Comparative liquid developer (the charge-controlling agent only) | plus | 48 mv/sec |
| Liquid developer (N) of Example 11 | plus | 110 mv/sec |
| Comparative liquid developer (the charge-controlling agent only) | plus | 38 mv/sec |

It can be understood that the liquid developers of the present invention that use charge-controlling agents, quaternary ammonium salts, and acid group-containing resins in combination are high in charge and excellent in charge properties in comparison with Comparative liquid developers that use charge-controlling agents only.

EXAMPLE 12

The printing original plate given below was charged with +330 volts in the dark by a corona charging device; it was then exposed to tungsten light, and was developed by the conventional reversal development technique at a bias voltage of +100V to +250V using the present liquid developers described in Examples 1 to 11. White images free from flow-out of the image and from double image (fringe occurring around the image) were obtained. On the other hand, in the case of Comparative liquid developers, generally appreciable images were obtained, but the images had flow-out of the image and a double image and were poor in image quality in comparison with the case of the present liquid developers. Then, after the images developed with these liquid developers were fixed, the non-image area was dissolved out in the usual manner to produce printing blocks and printing was effected, which gave good quality printed matters.

PREPARATION OF PRINTING ORIGINAL PLATE

The surface of a JIS 1050 aluminum sheet was grained by a rotating nylon brush using a pumice/water suspension as an abrasive. The surface roughness (center line average roughness) was 0.5 μm. After washing with water, the sheet was dipped and etched in a 10% aqueous sodium hydroxide solution, so that the amount of dissolved aluminum might be 6 g/m$^2$ Then, after washing with water, the sheet was dipped in a 30% aqueous nitric acid solution for 1 min, for neutralization, and then was washed with water. Thereafter, electrolytic surface roughing was effected for 20 sec using a rectangular wave alternating waveform, with a voltage of 13 volts at the time of the anode and a voltage of 6 volts at the time of the cathode (described in JP-B No. 1919/1980); then the sheet was dipped in a 20% sulfuric acid solution at a temperature of 50° C., to wash the surface, followed by washing with water. Further, the surface was anodized so that the weight of the anodic oxidized film might be 3.0 g/m$^2$, followed by washing with water and drying, thereby preparing a substrate.

Then, the below-mentioned coating liquid (1) for a photoconductive layer was applied on this substrate by a bar coater and was dried at 120° C. for 10 min to prepare a printing original plate for electrophotographic process. The coating liquid for a photoconductive layer:

| | |
|---|---|
| ε-type copper phthalocyanine (Liophoton-ERPC, manufactured by Toyo Ink Mfg. Co., Ltd.) | 1.0 part |
| Copolymer of benzyl methacrylate and methacrylic acid (methacrylic acid: 30 mol %) | 10.0 part |
| Tetrahydrofuran | 48.0 part |
| Cyclohexanone | 16.0 part |

The above components were dispersed together with glass beads in a 300-ml glass container by a paint shaker (made by Toyo Seiki Seisakusho Co.) for 60 min thereby preparing a dispersion for a photoconductive layer.

The dried film thickness of the thus prepared printing original plate for electrophotographic process was 4 μm.

EXAMPLES 13 TO 15

A mixed solution of 20 g of poly(stearyl methacrylate), 100 g of vinyl acetate, and 300 g of "Isopar H" was heated to a temperature of 70° C. under a flow of nitrogen with stirring. Then 1.5 g of 2,2'-azobis-(isobutyronitrile) was added and the reaction was effected for 5 hours. A white latex dispersion having a particle size of 0.18 μm was obtained.

This latex dispersion and additives of the present invention were mixed in ratios given below, to prepare liquid developers of the present invention and comparative liquid developers, and similarly to Example 1, the polarity and charge were examined.

| | |
|---|---|
| Comparative liquid developer (O): | |
| 1. Latex dispersion | 24 g |
| 2. Isopar G solution containing 1% of the charge-controlling agent resin of Preparatory Example (2) | 3 g |
| 3. Isopar G | 723 g |
| Example 13 | |
| Liquid developer (P): | |
| 1. Latex dispersion | 24 g |
| 2. Isopar G solution containing 1% of the charge-controlling agent resin of Preparatory Example (2) | 3 g |
| 3. Isopar G solution containing 10% of the acid group-containing polymer (7) of the present invention | 15 g |
| 4. Isopar G | 708 g |
| Example 14 | |
| Liquid developer (Q): | |
| 1. Latex dispersion | 12 g |
| 2. Isopar G solution containing 1% of the charge-controlling agent resin of Preparatory Example (2) | 3 g |
| 3. Isopropyl alcohol solution containing 1% of tetra-n-butyl ammonium chloride | 1 g |
| 4. Isopar G | 727 g |
| Example 15 | |
| Liquid developer (R): | |
| 1. Latex dispersion | 24 g |
| 2. Isopar G solution containing 1% of the charge-controlling agent resin of Preparatory Example (2) | 3 g |
| 3. Isopropyl alcohol solution containing 1% of tetra-n-butyl ammonium chloride | 1 g |
| 4. Isoper G solution containing 10% of the acid-group containing polymer (7) of the present invention | 15 g |
| 5. Isopar G | 707 g |

| | Polarity | Charge |
|---|---|---|
| Comparative liquid developer (O) | plus | 38 mv/sec |
| Liquid developer (P) of Example 13 | plus | 61 mv/sec |
| Liquid developer (Q) of Example 14 | plus | 108 mv/sec |
| Liquid developer (R) of Example 15 | plus | 120 mv/sec |

All of liquid developers of the present invention, which comprise a combination of a charge-controlling agent and an acid group-containing polymer, a combination of a charge-controlling agent and a quaternary ammonium salt, and a combination of a charge-controlling agent, an acid group-containing polymer, and a quaternary ammonium salt, respectively, were greater in charge and more excellent in charge properties than Comparative liquid developers wherein only charge-controlling agents were contained. Development was effected similarly to Example 12, and the liquid developers of the present invention gave excellent images almost free from flow-out of the image and from double image, in comparison with the Comparative liquid developers.

EXAMPLES 16 TO 18

| | |
|---|---|
| Carbon black No. MA-100 (manufactured by Mitsubishi Chemical Industries, Ltd.) | 1 wt. pt. |
| Solprene 303 (styrene/butadiene copolymer, manufactured by Asahi Chemical Industry Co., Ltd.) | 2 wt. pts. |
| Toluene | 20 wt. pts. |

A mixture of the above components was dispersed for a whole day and night by a ball mill, then the dispersion was poured into "Isopar G", and the precipitate was filtered. The precipitate was mixed with a solution of 40 parts by weight of "Isopar G" in which 2 parts by weight of Solprene 1205 (styrene/butadiene copolymer, manufactured by Asahi Chemical Industry Co., Ltd.) had been dissolved, and was dispersed by a ball mill for three days and three nights, thereby obtaining a toner concentrate. The particle size was 0.38 μm. Using this dispersion, liquid developers of the present invention and Comparative liquid developers were prepared, then similarly to Example 1, the polarity and the charge were examined, and similarly to Example 12, the image quality was examined.

| | |
|---|---|
| Comparative liquid developer (S): | |
| 1. Dispersion | 30 g |
| 2. Isopar G solution containing 1% of the charge-controlling agent resin of the present invention of Preparatory Example (1) | 10 g |
| 3. Isopar G | 710 g |
| Example 16 | |
| Liquid developer (T): | |
| 1. Dispersion | 30 g |
| 2. Isopar G solution containing 1% of the charge-controlling agent resin of Preparatory Example (1) | 10 g |
| 3. Isopar G solution containing 10% of the acid group-containing polymer (9) of the present invention | 5 g |
| 4. Isopar G | 705 g |
| Example 17 | |
| Liquid developer (U): | |
| 1. Dispersion | 30 g |
| 2. Isopar G solution containing 1% of the charge-controlling agent resin of Preparatory Example (1) | 10 g |
| 3. Isopropyl alcohol solution containing 1% of tetrahexyl ammonium iodide | 3 g |
| 4. Isopar G | 707 g |

-continued

| Example 18 | |
|---|---|
| Liquid developer (V): | |
| 1. Dispersion | 30 g |
| 2. Isopar G solution containing 1% of the charge-controlling agent resin of Preparatory Example (1) | 10 g |
| 3. Isopropyl alcohol solution containing 1% of tetrahexyl ammonium iodide | 3 g |
| 4. Isopar G solution containing 10% of the acid-group containing polymer (9) of the present invention | 5 g |
| 5. Isopar G | 702 g |

| | Polarity | Charge |
|---|---|---|
| Comparative liquid developer (S) | plus | 24 mv/sec |
| Liquid developer (U) of Example 16 | plus | 58 mv/sec |
| Liquid developer (V) of Example 17 | plus | 88 mv/sec |
| Liquid developer (W) of Example 18 | plus | 103 mv/sec |

All of the liquid developers of the present invention were excellent in charge properties in comparison with the comparative liquid developers, and also were excellent in image quality (flow-out of the image, the double image, and reproduction of halftone dots) in comparison with the comparative liquid developers.

Having described our invention as related to the embodiment, it is our intention that the invention be not limited by any of the details of the description, unless otherwise specified, but rather be construed broadly within its spirit and scope as set out in the accompanying claims.

We claim:

1. A liquid developer for electrostatic photography, which comprises, in a nonaqueous solvent having an electric resistance of at least $10^9$ Ω.cm and a dielectric constant of up to 3.5, (a) a toner containing at least a resin, (b) a charge-controlling agent resin or a charge-controlling agent, and (c) an acid group-containing polymer soluble in said nonaqueous solvent;

wherein said charge-controlling agent resin is a copolymer comprising a reaction product of a polymer comprising maleic anhydride and at least one monomer that can be polymerized to form a polymer soluble in said nonaqueous solvent, with a primary amino compound or a mixture of a primary amino compound and a secondary amino compound, and comprising hemimaleic acid amide components and maleinimide components as repeating units.

2. A liquid developer for electrostatic photography, which comprises, in a nonaqueous solvent having an electric resistance of at least $10^9$ Ω.cm and a dielectric constant of up to 3.5, (a) a toner containing at least a resin, (b) a charge-controlling agent, and (c) a quaternary ammonium salt;

wherein said charge-controlling agent is a metal soap soluble in said nonaqueous solvent.

3. A liquid developer for electrostatic photography, which comprises, in a nonaqueous solvent having an electric resistance of at least $10^9$ Ω.cm and a dielectric constant of up to 3.5, (a) a toner containing at least a resin, (b) a charge-controlling agent resin, and (c) a quaternary ammonium salt;

wherein said charge-controlling agent resin is a copolymer comprising a reaction product of a polymer comprising maleic anhydride and at least one monomer that can be polymerized to form a polymer soluble in said nonaqueous solvent, with a primary amino compound or a mixture of a primary amino compound and a secondary amino compound, and comprising hemimaleic acid amide components and maleinimide components as repeating units.

4. The liquid developer for electrostatic photography as claimed in claim 1, wherein said charge-controlling agent is a metal soap soluble in said nonaqueous solvent.

5. A liquid developer for electrostatic photography, which comprises, in a nonaqueous solvent having an electric resistance of at least $10^9$ Ω.cm and a dielectric constant of up to 3.5, (a) a toner containing at least a resin, (b) a charge-controlling agent resin or a charge-controlling agent, and (c) a quaternary ammonium salt that is insoluble or sparingly soluble in said nonaqueous solvent.

6. A liquid developer for electrostatic photography, which comprises, in a nonaqueous solvent having an electric resistance of at least $10^9$ Ω.cm and a dielectric constant of up to 35, (a) a toner containing at least a resin, (b) a charge-controlling agent resin or a charge-controlling agent, (c) a quaternary ammonium salt, and (d) an acid group-containing polymer soluble in said nonaqueous solvent.

7. The liquid developer for electrostatic photography as claimed in claim 6, wherein said charge-controlling agent is a metal soap soluble in said nonaqueous solvent.

8. The liquid developer for electrostatic photography as claimed in claim 6, wherein said charge-controlling agent resin is a copolymer, which is a reaction product of a polymer made up of maleic anhydride and at least one monomer that can be polymerized to form a polymer soluble in said nonaqueous solvent, with a primary amino compound or a mixture of a primary amino compound and a secondary amino compound, and which contains hemimaleic acid amide components and maleinimide components as repeating units.

9. The liquid developer for electrostatic photography as claimed in claim 1, wherein the toner is present in an amount of 0.1 to 50 parts by weight per 1,000 parts by weight of the nonaqueous solvent.

10. The liquid developer for electrostatic photography as claimed in claim 5, wherein the toner is present in an amount of 0.1 to 50 parts by weight per 1,000 parts by weight of the nonaqueous solvent.

11. The liquid developer for electrostatic photography as claimed in claim 6, wherein the toner is present in an amount of 0.1 to 50 parts by weight per 1,000 parts by weight of the nonaqueous solvent.

12. The liquid developer for electrostatic photography as claimed in claim 1, wherein said (b) is present in an amount of 0.0001 to 3 parts by weight per 1,000 parts by weight of the nonaqueous solvent.

13. The liquid developer for electrostatic photography as claimed in claim 5, wherein said (b) is present in an amount of 0.0001 to 3 parts by weight per 1,000 parts by weight of the nonaqueous solvent.

14. The liquid developer for electrostatic photography as claimed in claim 6, wherein said (b) is present in an amount of 0.0001 to 3 parts by weight per 1,000 parts by weight of the nonaqueous solvent.

15. The liquid developer for electrostatic photography as claimed in claim 1, wherein the acid group-containing polymer is present in an amount of 0.0001 to 30 parts by weight per 1,000 parts by weight of the nonaqueous solvent.

16. The liquid developer for electrostatic photography as claimed in claim 6, wherein said acid group-containing polymer is present in an amount of 0.0001 to 30 parts by weight per 1,000 parts by weight of the nonaqueous solvent.

17. The liquid developer for electrostatic photography as claimed in claim 5, wherein the quaternary ammonium salt is present in an amount of 0.0001 to 10 parts by weight per 1,000 parts by weight of the nonaqueous solvent.

18. The liquid developer for electrostatic photography as claimed in claim 6, wherein the quaternary ammonium salt is present in an amount of 0.0001 to 10 parts by weight per 1,000 parts by weight of the nonaqueous solvent.

19. The liquid developer for electrostatic photography as claimed in claim 1, wherein the monomer that can be polymerized to form a polymer is selected from the group consisting of alkenes having 10 or more carbon atoms, vinyl ethers, acrylic acids and methacrylic acids.

20. The liquid developer for electrostatic photography as claimed in claim 1, wherein the amino compound is an amine having an alkyl group with 8 or more carbon atoms.

* * * * *